US008602281B2

(12) United States Patent
Belleculee et al.

(10) Patent No.: US 8,602,281 B2
(45) Date of Patent: Dec. 10, 2013

(54) DEVICE FOR DRIVING ONE OR MORE SUPERPOSED WEBS FOR A ROTARY PRESS, AND ROTARY PRESS

(75) Inventors: Cyrille Belleculee, Les Sorinières (FR); Michel Griffon, Gorges (FR)

(73) Assignee: Goss Systemes Graphiques Nantes, Nantes (FR)

( * ) Notice: Subject to any disclaimer, the term of this patent is extended or adjusted under 35 U.S.C. 154(b) by 324 days.

(21) Appl. No.: 12/229,666

(22) Filed: Aug. 26, 2008

(65) Prior Publication Data

US 2009/0057363 A1 Mar. 5, 2009

(30) Foreign Application Priority Data

Aug. 27, 2007 (FR) ..... 07 57191

(51) Int. Cl.
*B65H 20/02* (2006.01)
*B65H 27/00* (2006.01)

(52) U.S. Cl.
USPC ..... 226/179; 226/185

(58) Field of Classification Search
USPC ..... 226/174, 179, 181, 185, 192, 18, 19, 226/21; 242/563.1
See application file for complete search history.

(56) References Cited

U.S. PATENT DOCUMENTS

| | | | | |
|---|---|---|---|---|
| 2,871,011 | A * | 1/1959 | Hercik | 226/179 |
| 3,107,036 | A * | 10/1963 | Alexeff et al. | 242/615.1 |
| 3,331,126 | A * | 7/1967 | Fielder et al. | 29/603.26 |
| 4,049,486 | A * | 9/1977 | Henley | 226/184 |
| 4,269,594 | A * | 5/1981 | Umans et al. | 432/59 |
| 4,666,423 | A * | 5/1987 | Herrington | 493/394 |
| 4,704,842 | A * | 11/1987 | Boeckmann et al. | 53/450 |
| 5,219,159 | A * | 6/1993 | Malachowski et al. | 271/228 |
| 5,273,274 | A * | 12/1993 | Thomson et al. | 271/228 |
| 6,352,188 | B1 * | 3/2002 | Piccinino et al. | 226/19 |
| 7,197,971 | B2 * | 4/2007 | Trovinger | 83/256 |
| 7,300,046 | B2 * | 11/2007 | Sugiyama et al. | 270/58.17 |
| 2004/0050895 | A1 | 3/2004 | Zweifel et al. | |
| 2007/0057005 | A1 | 3/2007 | Theilacker | |

* cited by examiner

*Primary Examiner* — Sang Kim
*Assistant Examiner* — Scott Haugland
(74) *Attorney, Agent, or Firm* — Davidson, Davidson & Kappel, LLC

(57) ABSTRACT

The present invention provides two counter-rotating rollers having substantially parallel axes of rotation which are provided to grip the web(s) between them and to cause the web(s) to move along as a result of their rotation, each roller having two spaced cylindrical support surfaces each defining a zone for gripping the web(s) with a corresponding, opposing, support surface of the other roller. The rollers are displaceable relative to each other in the direction of the axes of rotation and a displacement of one of the rollers relative to the other in the direction of the axes of rotation modifies a distance between the gripping zones. A rotary press is also provided.

25 Claims, 3 Drawing Sheets

DEVICE FOR DRIVING ONE OR MORE SUPERPOSED WEBS FOR A ROTARY PRESS, AND ROTARY PRESS

This claims the benefit of FR 07 57191 filed on Aug. 27, 2007, and hereby incorporated by reference herein.

The invention relates to a device for driving one or more printing webs, which is to be used in a rotary press, of the type comprising two counter-rotating rollers which have substantially parallel axes of rotation and which are provided to grip the web(s) between them and to cause the web(s) to move along as a result of their rotation.

BACKGROUND OF THE INVENTION

Drive devices of this type define two spaced gripping zones. They are generally located downstream of printing units in order to grip non-printed marginal regions of the web(s) so as to avoid gripping the printed regions, which would involve the risk of smudging any ink that was still wet.

SUMMARY OF THE INVENTION

It may be advantageous if a rotary press is able to receive printing webs of different widths, and consequently to be able to modify the distance between the gripping zones.

An object of the invention is to provide a device for driving one or more superposed webs to be printed, which device is to be used in a rotary press and enables a distance between the gripping zones to be readily modified.

The present invention provides a device for driving one or more printing webs, characterized in that the rollers are displaceable relative to each other in the direction of the axes of rotation, and in that a displacement of one of the rollers relative to the other in the direction of the axes of rotation modifies a distance between the gripping zones.

According to other embodiments, the drive device may include one or more of the following features, taken in isolation or in accordance with any technically possible combination:

- at least one of the rollers is mounted to slide along its axis of rotation,
- each roller is mounted to slide along its axis of rotation,
- each gripping zone preserves the same width during a relative axial displacement of the rollers, over at least one range of adjustment,
- each roller has a support surface wider than the corresponding support surface of the other roller,
- each roller has a support surface wider than the other,
- the small-width support surfaces of the rollers have the same width,
- the large-width support surfaces of the rollers have the same width,
- each roller has a shaft and rings mounted removably on the shaft at a predetermined position, each ring defining one of the support surfaces of the roller.

The invention also provides a rotary press, including at least one folding former and a drive device, located downstream of the folding former in order to keep a web or several superposed webs under tension on the folding former.

BRIEF DESCRIPTION OF THE DRAWINGS

The invention and its advantages will be better understood on reading the following description which is given purely by way of example and with reference to the appended drawings, in which.

DETAILED DESCRIPTION OF A PREFERRED EMBODIMENT

Figure 1:
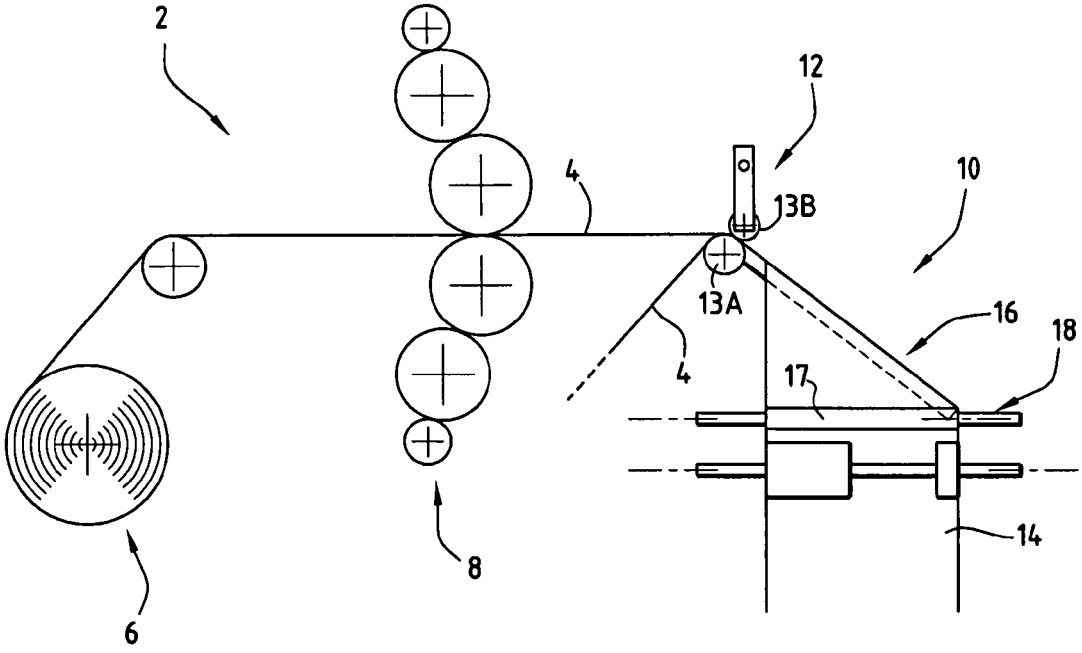
FIG. 1 is a general diagrammatic side view of a rotary press.

The rotary press 2 shown in FIG. 1 enables several webs 4 of material, for example webs of paper, to be printed and enables them to be joined to form a product such as a newspaper.

The press 2 comprises, for each web 4, an unwinding unit 6 for unwinding the web 4 from a supply roll, and at least one printing unit 8 for printing the web 4. For the sake of clarity, only the unwinding unit 6 and a recto/verso printing unit 8, which are associated with a web 4, have been shown in FIG. 1.

The press 2 has a longitudinal folding unit 10 receiving several webs 4 after they have been printed.

The folding unit 10 has, from upstream to downstream, a collecting device 12 for collecting several webs 4 and joining them into an assembly 14 formed by the superposed webs, a longitudinal folding former 16 for forming a longitudinal crease in the assembly 14, a pair of guide rollers 17, and a drive device 18 for driving the assembly 14 and keeping it under tension between the collecting device 12 and the drive device 18.

The collecting device 12 has, in known manner, a collecting roller 13A and upper collecting rolls 13B defining between them a single passage for the webs 4 arriving from different directions, in order to form the assembly 14.

The collecting roller 13A extends transversely relative to the webs 4 and has a cylindrical surface extending over the entire width of the webs. It is generally motorized in order to drive the webs 4.

The rolls 13B are provided to press the assembly 14 against the collecting roller 13A. The rolls 13B are spaced in order to rest on non-printed zones of the webs 4 of the assembly 14. In known manner, the rolls 13B are carried by arms which are themselves carried by a common shaft.

Figure 2:
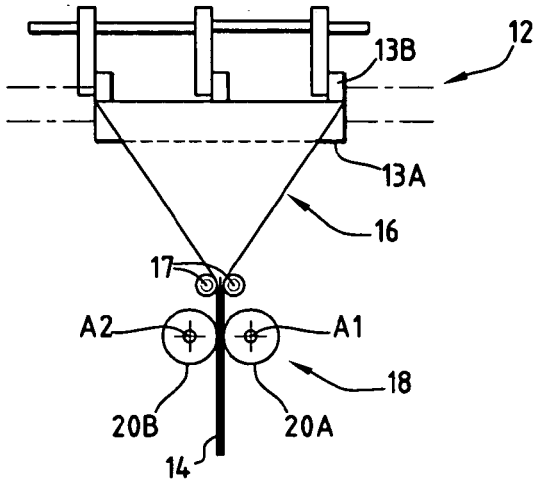
FIG. 2 is a front view of a longitudinal folding unit (or longitudinal folder) of the press of FIG. 1.

As shown in FIG. 2, the folding former 16 is formed in known manner by a substantially triangular plate having a transverse rear edge and two lateral edges which form a front tip directed downstream, and around which two folds of the assembly 14 are deflected in such a manner that the front tip forms a longitudinal crease between the two folds.

The collecting roller 13A is arranged along the rear edge of the folding former 16. The collecting roller 13A is generally called a roller top of the former or RTF in abbreviated form.

In known manner, the folding former 16 has nozzles for injecting air under pressure in order to form a film of air between it and the assembly 14, so as to limit friction.

The guide rollers 17 are located one on each side of the folded assembly 14 substantially at the level of the tip of the former 16. The guide rollers 17 are arranged substantially transversely to the direction of movement of the folded assembly 14 downstream of the former 16. They are mounted to rotate freely.

Each guide roller 17 guides one of the folds of the assembly 14 to ensure suitable winding of that fold around the corresponding lateral edge of the former 16. The guide rollers 17 do not grip the assembly 14 between them.

The drive device 18 comprises a first roller 20A and a second roller 20B which are counter-rotating and have parallel axes of rotation A1 and A2, respectively, and which are provided to grip the folded assembly 14 and to cause it to move between them as a result of their rotation.

Such rollers 20A and 20B, located downstream of the guide rollers 17 to drive and keep under tension the web or the plurality of webs passing over the folding former, are generally called "lap rollers".

Figure 3:
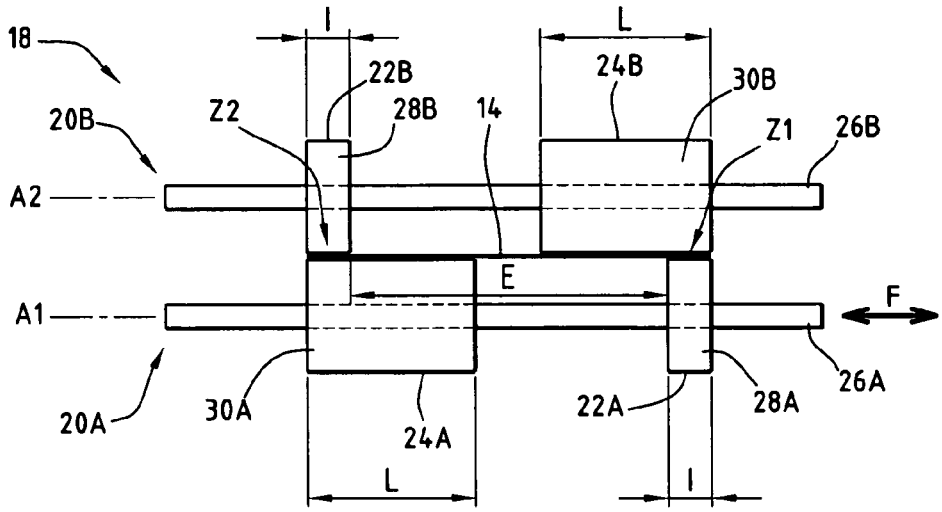
FIGS. 3 and 4 are top views of a device for driving, according to the invention, the folding unit of FIG. 2.
Figure 4:
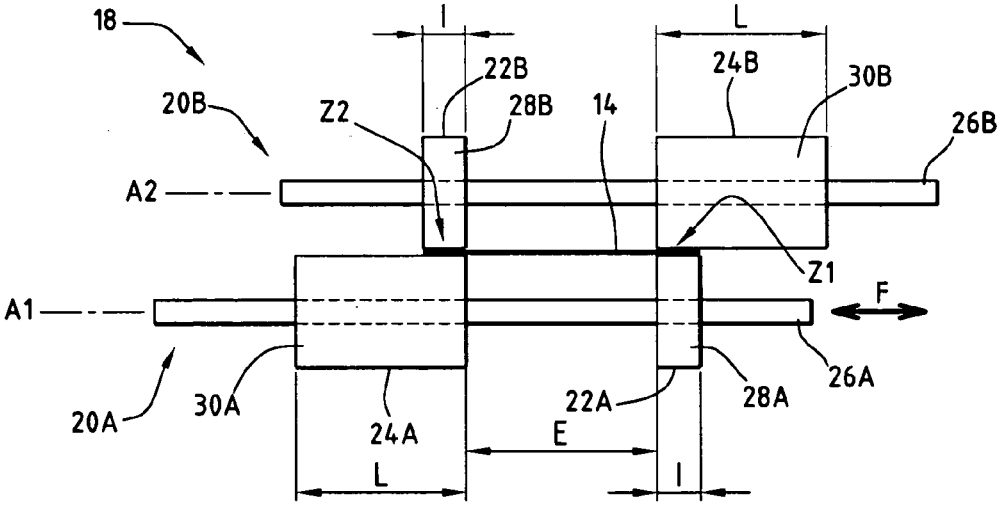

As shown in FIGS. 3 and 4, the rollers 20A, 20B define between them two gripping zones Z1, Z2 which are spaced in the direction of the axes A1, A2 of the rollers 20A, 20B.

The spaced gripping zones Z1, Z2 enable the assembly 14 to be gripped in non-printed marginal regions in order to limit the risk of the formation of ragged edges by smudging any ink deposited on the webs 4 that is still wet.

In known manner, the rollers 20A and 20B are driven in rotation in opposite directions by one or more motors.

The first roller 20A has a support surface 22A of small width, and a support surface 24A of large width, which are spaced along the axis A1. The support surfaces 22A and 24A are cylindrical with an axis A1 and have the same diameter.

The second roller 20B has a support surface 22B of small width and a support surface 24B of large width, which are spaced along the axis A2. The support surfaces 22B and 24B are cylindrical with an axis A2 and have the same diameter.

The "width" of a support surface means the dimension of that support surface in the direction of the axes of rotation of the rollers 20A and 20B.

The small-width support surfaces 22A, 22B of the rollers 20A, 20B have the same width l and the large-width support surfaces 24A, 24B of the rollers 20A, 20B have the same width L.

The rollers 20A, 20B are arranged head-to-tail, so that the small-width support surface 22A of the roller 20A and the large-width support surface 24B of the roller 20B are located opposite each other and define the gripping zone Z1, and the large-width support surface 24A of the roller 20A and the small-width support surface 22B of the roller 20B are located opposite each other and define the gripping zone Z2.

The width of the gripping zones Z1, Z2 is equal to the width l of the small-width support surfaces 22A, 22B.

The distance E between the gripping zones Z1, Z2 is equal to the distance in the direction of the axes A1 and A2 between the small-width support surfaces 22A, 22B of the rollers 20A, 20B.

The rollers 20A, 20B are displaceable relative to each other in the direction of the axes A1 and A2, as illustrated by the double arrow F in FIGS. 3 and 4.

The displacement of one of the rollers 20A, 20B as a whole relative to the other brings about a joint displacement of the support surfaces of that roller relative to the support surfaces of the other roller. Such a displacement modifies the distance E between the gripping zones Z1 and Z2.

The rollers 20A, 20B are displaceable between a first position of maximum distance E (FIG. 3) and a second position of minimum distance E (FIG. 4).

In the first position (FIG. 3), the small-width support surface 22A, 22B of each roller 20A, 20B is located opposite the axial end portion of the large-width support surface 24B, 24A, respectively, of the other roller 20B, 20A, respectively, opposite the small-width support surface 22B, 22A, respectively, of that other roller 20B, 20A respectively.

In the second position (FIG. 4), the small-width support surface 22A, 22B of each roller 20A, 20B is located opposite the axial end portion of the large-width support surface 24B, 24A, respectively, of the other roller 20B, 20A, respectively, adjacent to the small-width support surface 22B, 22A, respectively, of that other roller 20B, 20A, respectively.

In the first position (FIG. 3), the support surfaces 24A, 24B are close together but, in order to prevent the assembly 14 from being gripped between the support surfaces 24A, 24B, support surfaces 24A, 24B do not overlap each other.

The rollers 20A, 20B can be immobilized in their position relative to each other in the direction of their axes A1 and A2 in order to maintain the selected distance E.

The variable distance E between the gripping zones Z1 and Z2 enables webs of different widths to be driven. The distance E can be readily adjusted simply by displacing one of the rollers 20A, 20B relative to the other.

In addition, owing to the provision of support surfaces 22A, 22B, and 24A, 24B of different widths l and L, respectively, and owing to their distribution in opposition (rollers 20A and 20B arranged head-to-tail), the adjustment of the distance E does not modify the width of the gripping zones Z1, Z2 at least over a range of adjustment of the distance E equal to the difference between the large width L and the small width l.

It is therefore possible to drive in a reliable manner the web(s) moving between the rollers 20A, 20B without straying into the printed zones of the web(s). The width of the gripping zones Z1 and Z2 is preferably, for example, from 10 to 20 mm.

The distance E is adjusted, if necessary, during a change of web(s) for webs of different width, with a view to printing different products. The distance is also optionally modified in the course of printing if it is detected that it is necessary to adjust the distance.

As shown in FIGS. 3 and 4, the rollers 20A have a rotary shaft 26A of axis A1, a ring 28A of small width defining the small-width support surface 22A and a ring 30A of large width defining the large-width support surface 24A. The rings 28A and 30A are removably mounted on the shaft 26A, each at a predetermined site along the shaft 26A.

Similarly, the roller 20B has a rotary shaft 26B of axis A1, a removable ring 28B of small width defining the small-width support surface 22B and a removable ring 30B of large width defining the large-width support surface 24B.

This enables the rings 28A, 30A, 28B and 30B to be replaced when wear has been detected without replacing the rollers 20A, 20B as a whole.

The support surfaces 22A, 22B, 24A, and 24B are advantageously provided on coatings of, for example, tungsten, a material which is very resistant to wear but expensive. Nevertheless, the arrangement of the support surfaces of large width and small width opposite each other permits easy adjustment of the distance E with rings of limited length, which limits the amount of coating necessary.

In order to permit the displacement and adjustment in relative position of the rollers 20A, 20B as shown in FIGS. 3 and 4, the first roller 20A is mounted to slide along its axis A1, and the second roller 20B is fixed in translation along its axis A2.

Figure 5:
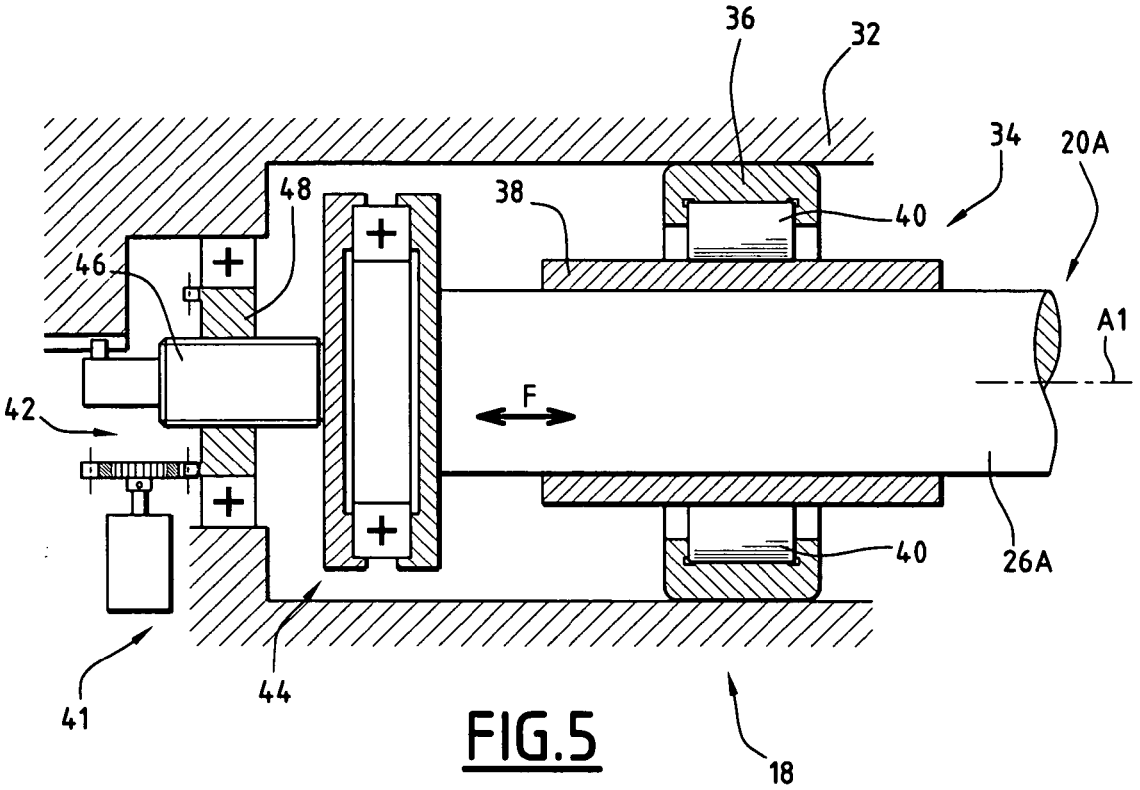
FIG. 5 is a detailed view of the drive device of FIGS. 3 and 4.

As shown in FIG. 5, which illustrates one of the axial ends of the shaft 26A of the roller 20A, the said end of the shaft 26A is mounted to rotate on a frame 32 of the device 18 by means of a roller bearing 34 of axis A1 permitting relative axial displacement between the shaft 26A and the frame 32.

To that end, the roller bearing 34 comprises an external ring 36 secured to the frame 32, an internal ring 38 secured to the shaft 26A and rolling members 40 located between the external ring 36 and the internal ring 38.

The rolling members 40 are locked axially relative to the external ring 36. The internal ring 38 has a rolling path for the rolling members 40 which is longer axially than the rolling members 40.

The lubrication present in the roller bearing 34 enables the internal ring 38 to slide along the axis A1 relative to the external ring 38, as illustrated by the double arrow F.

The other end of the shaft 26A is mounted to rotate on the frame 32 by means of a second roller bearing of the same type as the roller bearing 34.

The drive device 18 comprises a device 41 for adjusting the axial position of the roller 20A. The device 41 for adjusting the axial position comprises a screw-and-nut system 42 of axis A1 and an axial rolling stop 44 located between the screw-and-nut system 42 and the roller 20A.

The screw-and-nut system 42 has a screw 46 arranged along the axis A1, and a nut 48 engaged on the screw 46. The screw 46 is locked in rotation about the axis A1 relative to the frame 32 and is mobile in translation along the axis A1 relative to the frame 32. The nut 48 is immobile in translation along the axis A relative to the frame 32, and is rotatable about the axis A1 relative to the frame 32.

The rotation of the nut 48 about the axis A1 enables the position of the screw 46 and therefore of the shaft 26A to be adjusted relative to the frame 32 along the axis A1. The adjustment of the axial position of the shaft 26A is continuous. The choice of an irreversible screw-and-nut system 42 enables the shaft 26A to be kept immobile in translation along the axis A1 when the nut 48 is not pivoting.

The rotation of the nut 48 is controlled manually, for example, by means of an adjusting flywheel coupled to the nut by gears, or by means of an actuator, for example, an electrical motor coupled to the nut by gears, as shown diagrammatically in FIG. 5.

In a variant, each roller 20A, 20B is displaceable axially and adjustable in position along its axis of rotation.

The adjustment of the distance E by the relative axial displacement of the rollers 20A and 20B as a whole permits easy adjustment of the distance E, without any intervention necessitating the dismounting of the device 18 and, optionally, without stopping the press 2.

The drive device 18 has been described located downstream of a folding former receiving several webs combined to form an assembly. It is of course possible to arrange the drive device downstream of a folding former receiving a single web, and downstream of a folding former receiving one or more superposed partial webs formed from one or more superposed webs cut in the longitudinal direction to form several partial webs or several partial assemblies of superposed webs, directed towards different folding formers.

In addition, only the functional units of the press 2 necessary for an understanding of the invention have been shown. The press 2 optionally comprises, in known manner, other functional units, such as units for drying the webs after printing, units for cooling the webs after drying, or units for longitudinal cutting, which are generally located upstream of the longitudinal folding former, or units for transverse folding or for stapling, which are generally located downstream of the longitudinal folding former.

What is claimed is:

1. A device for driving at least one printing web to be used in a rotary press comprising:

a first rotating roller including a first shaft having a first axis of rotation, a first gripping cylinder and a second gripping cylinder mounted on the first shaft, a width of the first gripping cylinder being less than a width of the second gripping cylinder;

a second rotating roller including a second shaft having a second axis of rotation, a third gripping cylinder and a fourth gripping cylinder mounted on the second shaft a width of the third gripping cylinder being greater than a width of the fourth gripping cylinder;

the first and second rollers being counter-rotating rollers, the first and second axes of rotation being substantially parallel, the two counter rotating rollers gripping the at least one web to cause the at least one web to move along as a result of the rotation;

the first and third gripping cylinders contacting the web therebetween and defining a first gripping zone, the second and fourth gripping cylinders contacting the web therebetween and defining a second gripping zone the web being gripped only in the gripping zones;

an entirety of the first or second rotating roller displaceable relative to an entirety of the second or first rotating roller, respectively, in a direction of the axes of rotation, the displacement of the entirety of the first rotating roller displacing both the first and second gripping cylinders, the displacement of the entirety of the second rotating roller displacing both the third and fourth gripping cylinders, the displacement of the first or second roller modifying a distance between the first and second gripping zones, a first width of the first gripping zone and a second width of the second gripping zone being maintained when the distance between the first gripping zone and second gripping zone is modified at least over a range of adjustment.

2. The drive device according to claim 1 wherein at least one of the rollers is mounted to slide along the respective axis of rotation.

3. The drive device according to claim 1 wherein each roller is mounted to slide along the respective axis of rotation.

4. The drive device according to claim 1 wherein the first gripping cylinder and the fourth gripping cylinder have the same width.

5. The drive device according to claim 1 wherein the second gripping cylinder and the third gripping cylinder have the same width.

6. The device according to claim 1 wherein each gripping cylinder is a ring mounted removably on the respective shaft at a predetermined position.

7. The device according to claim 1 wherein the rollers are configured such that during the displacement of one of the rollers relative to the other roller in the direction of the axes of rotation to modify the distance between the gripping zones an axial distance between the first and second gripping cylinders is fixed and an axial distance between the third and fourth gripping cylinders is fixed.

8. The device according to claim 1 wherein the gripping cylinders on at least one of the first or second counter-rotating rollers are integral with the first or second shaft respectively.

9. The device according to claim 1, wherein the range of adjustment is equal to a difference between the widths of the first and third gripping cylinders or between the widths of the second and fourth gripping cylinders.

10. The device according to claim 1 wherein the width of the first and second gripping zones is from 10 mm to 20 mm.

11. The device according to claim 1 wherein the distance between the first and second gripping zones is the distance between the first gripping cylinder and the fourth gripping cylinder.

12. The device according to claim 1 wherein the first rotating roller is displaced with respect to the web, a lateral position of the web remaining stationary.

13. The device according to claim 1 wherein the first rotating roller and second rotating roller are arranged head to tail.

14. A rotary press comprising:

at least one folding former; and a drive device located downstream of the folding former to keep a web or several superposed webs under tension on the folding former;

the drive device including two counter-rotating rollers each having an axis of rotation, the axes of rotation being substantially parallel and provided to grip the web or several superposed webs and to cause the web or several superposed webs to move along as a result of the rotation;

each roller having a shaft and two spaced gripping cylinders, the gripping cylinders defining first and second gripping zones for gripping the web or several superposed webs between corresponding, opposing ones of the gripping cylinders, the web being gripped only in the gripping zones, the two spaced gripping cylinders on each shaft having a different width from each other, the wide gripping cylinder on one of the shafts opposing the narrow gripping cylinder on the other shaft thereby defining the first gripping zone, the wide gripping cylinder on the other shaft opposing the narrow gripping cylinder on the one shaft thereby defining the second gripping zone, an entirety of one of the rollers being displaceable relative to an entirety of the other roller in the direction of the axes of rotation, a displacement of the one roller relative to the other roller in the direction of the axes of rotation modifying a distance between the first and second gripping zones, a first width of the first gripping zone and a second width of the second gripping zone being maintained when the distance between the first gripping zone and second gripping zone is modified at least over a range of adjustment.

15. The device according to claim 14 wherein the range of adjustment is equal to a difference between the wide gripping cylinders and the narrow gripping cylinders.

16. The device according to claim 14 wherein the rollers are arranged head to tail.

17. A device for driving at least one printing web to be used in a rotary press comprising:

a first roller rotatable about a first axis;

a second roller rotatable about a second axis, the first axis being parallel to the second axis, the first roller and the second roller cooperating to grip the at least one web and to cause the at least one web to move along as a result of the first roller and the second roller rotating;

the first roller having a first cylindrical support surface and a second cylindrical support surface a first distance from the first cylindrical support surface, the first cylindrical support surface being wider than the second cylindrical support surface, the second roller having a third cylindrical support surface and a fourth cylindrical support surface a second distance from the third cylindrical support surface, the fourth cylindrical support surface being wider than the third cylindrical support surface, the first cylindrical support surface and the third cylindrical support surface defining a first gripping zone and the second cylindrical support surface and the fourth cylindrical support surface defining a second gripping zone, the web being gripped only in the gripping zones, an entirety of the first roller being axially displaceable relative to an entirety of the second roller, the displacement of the first roller axially displacing the first and second cylindrical support surfaces together relative to the third and fourth cylindrical support surfaces, the displacement of the first roller modifying a distance between the first gripping zone and the second gripping zone;

a first width of the first gripping zone and a second width of the second gripping zone being maintained when the distance between the first gripping zone and second gripping zone is modified at least over a range of adjustment.

18. The device recited in claim 17 wherein the first roller includes a first shaft supporting the first and second cylindrical support surfaces such that the first shaft is axially displaceable together with the first and second cylindrical support surfaces relative to the third and fourth cylindrical support surfaces to modify the distance between the first gripping zone and the second gripping zone.

19. The device recited in claim 17 wherein the first cylindrical support surface is wider than the third cylindrical support surface and the fourth cylindrical support surface is wider than the second cylindrical support surface.

20. The device according to claim 19 wherein the first cylindrical support surface is equal in width to the fourth cylindrical support surface and the second cylindrical support surface is equal in width to the third cylindrical support surface.

21. The drive device according to claim 17 wherein the third and fourth cylindrical support surfaces are axially displaceable together relative to the first and second cylindrical support surfaces to modify the distance between the first gripping zone and the second gripping zone.

22. The device recited in claim 21 wherein the second roller includes a second shaft supporting the third and fourth cylindrical support surfaces such that the second shaft is axially displaceable together with the third and fourth cylindrical support surfaces relative to the first and second cylindrical support surfaces to modify the distance between the first gripping zone and the second gripping zone.

23. The drive device according to claim 17 wherein the first and second rollers are configured such that during the axial displacement of the first and second cylindrical support surfaces together relative to the third and fourth cylindrical support surfaces to modify the distance between the first gripping zone and the second gripping zone the first and second distances are fixed.

24. The device according to claim 17, wherein the range of adjustment is equal to a difference between widths of the first and third cylindrical support surfaces or between widths of the second and fourth cylindrical support surfaces.

25. The device according to claim 17 wherein the first roller and second roller are arranged head to tail.

* * * * *